United States Patent [19]

Pearce

[11] 4,217,834

[45] Aug. 19, 1980

[54] REMOVAL OF ASH FROM FLUIDIZED BEDS

[75] Inventor: Arnold P. Pearce, London, England

[73] Assignee: Flameless Furnaces Ltd., London, England

[21] Appl. No.: 901,655

[22] Filed: May 1, 1978

[30] Foreign Application Priority Data

May 2, 1977 [GB] United Kingdom ..... 18354/77

[51] Int. Cl.[2] ..... F23J 1/06

[52] U.S. Cl. ..... 110/165 R; 110/245

[58] Field of Search ..... 110/245, 165 R, 165 A; 431/7, 170; 34/57; 432/58; 122/4 D

[56] References Cited

U.S. PATENT DOCUMENTS 2,467,805 4/1949 Bressler ..... 110/165 R 3,910,208 10/1975 Albrecht et al. ..... 110/165 R 3,970,011 7/1976 Virr et al. ..... 110/245

*Primary Examiner*—Edward G. Favors

*Attorney, Agent, or Firm*—Ladas & Parry

[57] ABSTRACT

The invention provides in a fluidized bed combustion apparatus including a housing and means for supporting and fluidizing a bed of granular material in the housing for the combustion of waste or other fuel material, an ash removal means comprising: an ash trough, arranged along an edge of the means for supporting the bed, for the collection of ash from the bed, comprising at least a bottom wall, and an aperture in the bottom wall for the exit of ash from the trough, valve means arranged in the aperture for the selective control of the flow of ash through the aperture from the trough, and pneumatic conveyor means arranged to convey ash and any bed material accompanying it from the aperture for disposal.

12 Claims, 6 Drawing Figures

REMOVAL OF ASH FROM FLUIDIZED BEDS

BACKGROUND OF THE INVENTION

This invention relates to fluidised combustion apparatus and to incinerators embodying such equipment. The invention is particularly concerned with the removal of ash from the fluidised bed in such apparatus.

In the operation of fluidised bed combustion apparatus, the removal of ash from the bed has presented many difficulties. Problems arise because of the high temperature of the solid incombustible material which forms the ash in a fluidised bed combuster and the tendency for such ash to agglomerate and form clinker. Further it has proved virtually impossible to remove only the ash from the fluidised bed, some of the bed material inevitably being removed with the ash.

It is an object of the present invention to provide a method and apparatus for removing ash from a fluidised bed combuster which alleviates these difficulties.

SUMMARY OF THE INVENTION

Accordingly the present invention provides in a fluidised bed combustion apparatus including a housing and means for supporting and fluidising a bed of granular material in the housing for the combustion of waste or other fuel material, an ash removal means comprising: an ash trough, arranged along an edge of the means for supporting the bed, for the collection of ash from the bed, comprising at least a bottom wall, and an aperture in the bottom wall for the exit of ash from the trough, valve means arranged in the aperture for the selective control of the flow of ash through the aperture from the trough, and pneumatic conveyor means arranged to convey ash and any bed material accompanying it from the aperture for disposal.

BRIEF DESCRIPTION OF THE DRAWINGS

In order to promote a fuller understanding of the above, and other, aspects of the present invention, a preferred embodiment will now be described by way of example only, with reference to the accompanying drawings in which.

DESCRIPTION OF PREFERRED EMBODIMENT

Figure 1:
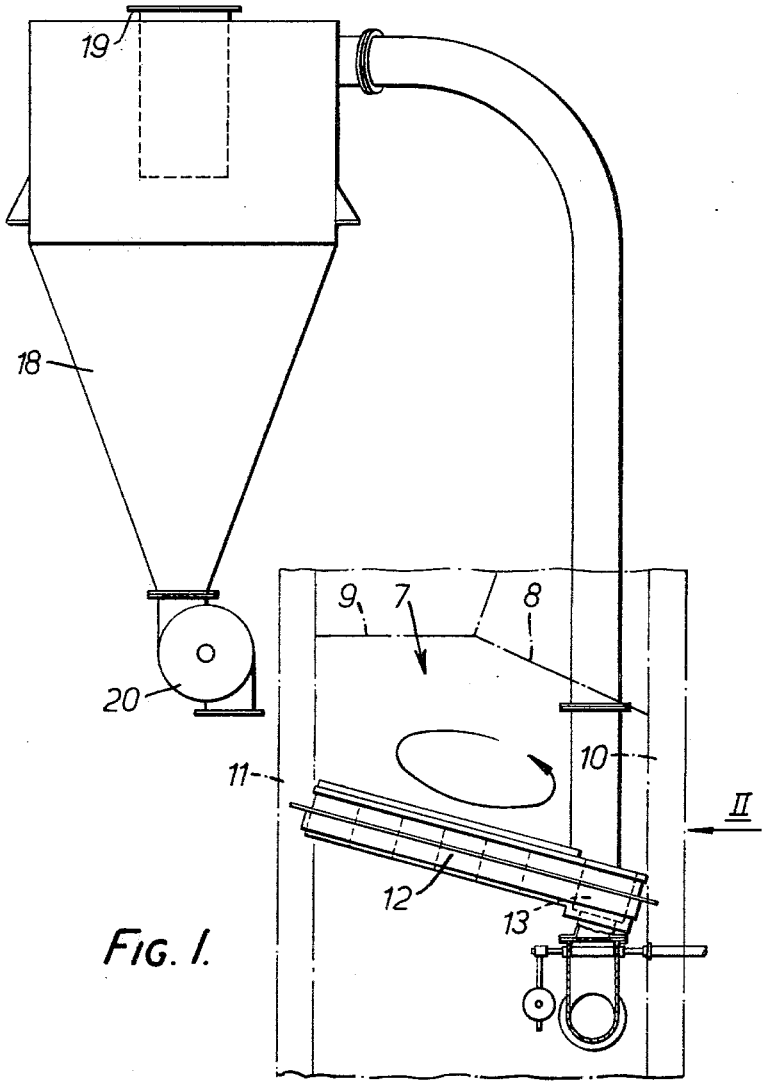
FIG. 1 shows a schematic cross-section of the diffuser and bed support of a typical fluidised bed combuster embodying the invention.

FIG. 1 shows in dotted outline the cross-section of a combuster housing embodying a fluidised bed. The front and back walls 10 and 11 only of the housing are shown. A fluidised bed support plate and diffuser indicated generally at 12 is provided in the bottom of the housing to support a bed of granular material indicated generally at 7 in the housing and to supply air to that bed of material thereby to fluidise it for the combustion of fuel or waste material in the bed in known manner per se for the generation of heat or for incineration purposes. The housing includes in known manner per se a baffle 8 extending over part of the diffuser 12, and the level of the bed material is typically as indicated at 9. Means for feeding material to the bed for combustion, and means for extracting the gaseous products of combustion from the housing are provided in known manner per se and are not shown in the drawings.

The diffuser 12 is arranged to slope downwardly from the back wall 11 to the front wall 10 so that incombustible material in the bed tends to accumulate towards the front wall of the housing. In order to promote such accumulation, the fluidised bed is preferably, although not essentially, arranged to circulate in operation about an axis extending into the plane of FIG. 1 across the slope of the diffuser 12, either so that bed material is moving in a downward direction across the face of the diffuser 12 in operation as shown by the arrow in FIG. 1, or in the opposite direction.

Figure 2:
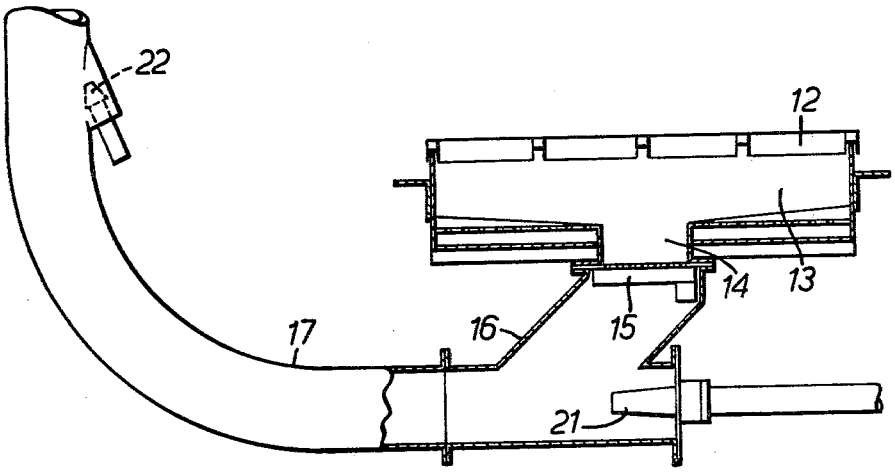
FIG. 2 shows a partial view on the arrow II of FIG. 1.
Figure 3:
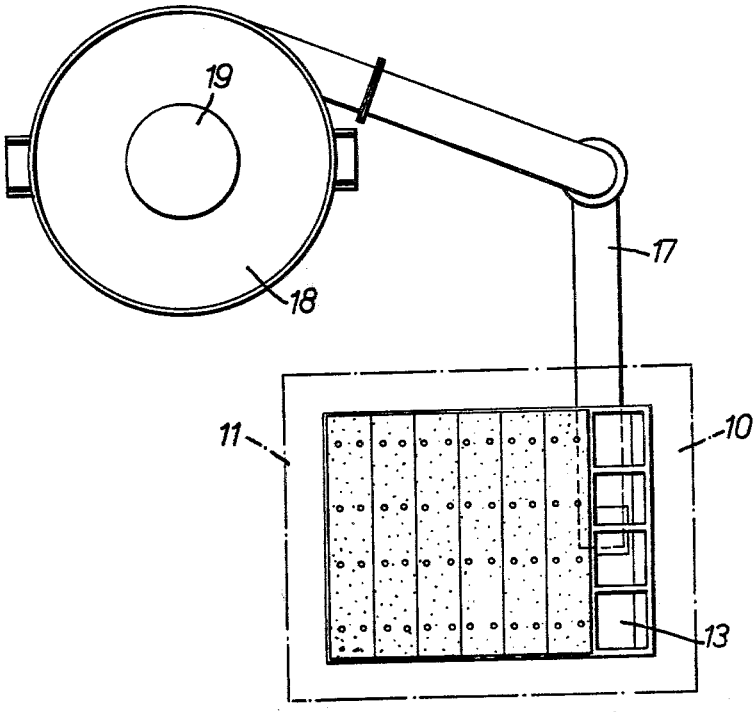
FIG. 3 shows a plan view of the arrangement of FIG. 1.

In order to collect the ash at the lower edge of the diffuser 12, a trough 13 is provided below the level of the diffuser surface. The bottom wall of the trough is arranged, as best seen in FIG. 2, to slope downwardly from each end towards the middle at which an exit aperture 14 is provided. The aperture 14 is normally closed by a flap valve 15; and when it is desired to extract ash from the bed during operation, the flap valve 15 is pivoted to an open position to allow ash material to fall down from the trough 13 through the aperture 14 into a housing 16.

The housing 16 encloses an angled conduit from the aperture 14 for connection to an upwardly curving duct 17. The duct 17 sweeps upwards from below the fluidised bed into an air cyclone separator indicated generally at 18. The cyclone separator 18 is of known design per se and no further description will be given of it except to say that it has an outlet 19 for gaseous and air borne materials, and a rotary vane valve outlet 20 at the bottom for heavier separated material.

The housing 16 has an air nozzle 21 positioned to inject air into the housing to convey pneumatically material falling through the aperture 14 when the flap valve 15 is open, up through the conduit 17 and into the cyclone separator 18. An additional air jet or jets may be positioned to promote such pneumatic conveyance at the various points in the duct 17, as indicated typically at 22. The air jets also provide the air flow to cause the cyclone separator to operate.

In order to assist the flow of ash and other material in the trough 13, through the aperture 14, particularly from either end of the trough, the bottom wall and the side walls of the trough 13 are formed as air diffusers supplied with fluidising air from an air jacket around the trough, so that the material in the trough is also fluidised. The flow of fluidising air through the air jacket around the bottom and side walls of the trough also help to cool it in operation.

Figure 4:
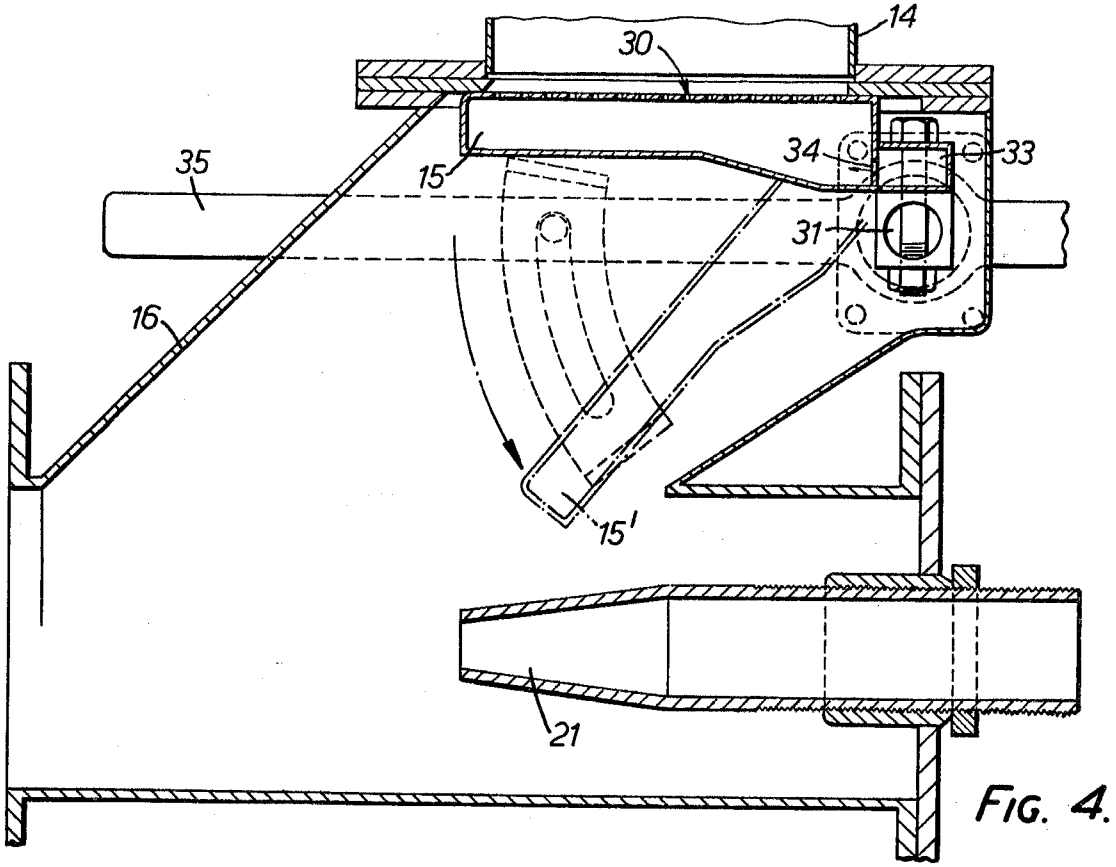
FIG. 4 shows an enlarged detail taken from FIG. 2.
Figure 5:
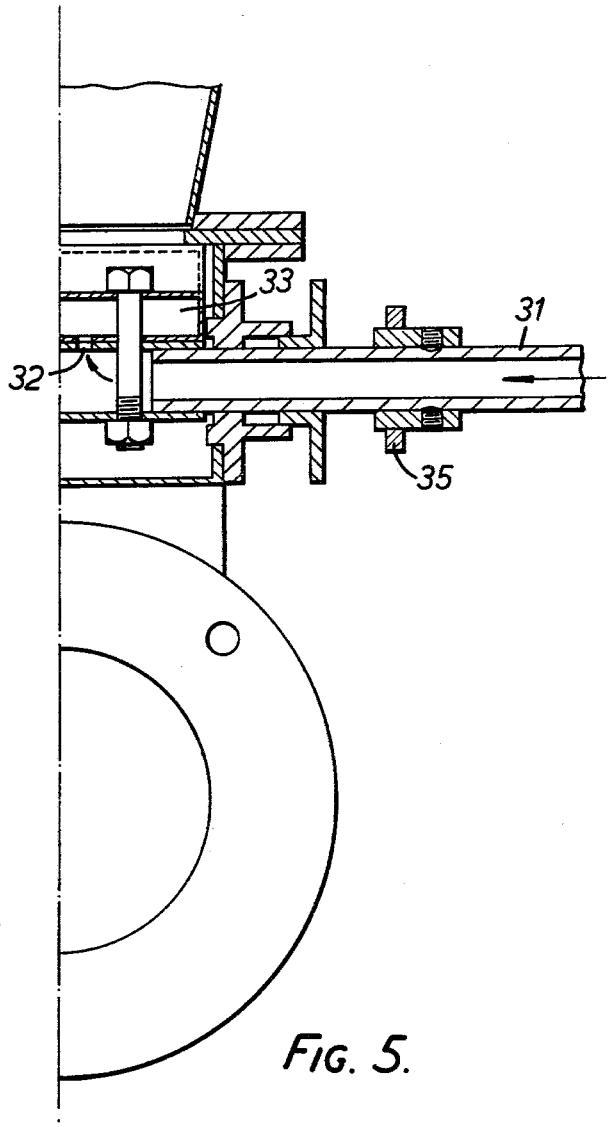
FIG. 5 shows a part cross-section on the line V—V of FIG. 4.

The construction of the flap valve 15 and the housing 16 is shown in more detail in FIGS. 4 and 5.

The flap valve 15 is constructed as a hollow steel fabrication and the upper surface 30 is perforated to form an air diffuser to fluidise ash and bed material lying on the surface 30. The flap valve 15 is pivotally mounted in the housing 16 by means of a hollow shaft 31 through which air is supplied to the interior of the valve 15 and thus to the diffuser surface 30. The flow of air through the shaft 31 passes through apertures 32 in the wall of the shaft into a chamber 33 forming part of the valve 15, and thence through apertures 34 into the body of the valve 15. The shaft 31 carrying the valve 15 extends outside the housing 16 for the connection of an air supply to it, and also to carry an operating handle 35 which also serves as a lever upon which a counter-balance weight (not shown) may be attached.

When the flap valve 15 is in the closed position as shown in FIG. 4, air emanating from the diffuser surface 30 fluidises ash and bed material above it helping to promote the flow of the heavier ash material into the aperture 14 from the bed diffuser and from the bottom walls of the ash trough. When the flap valve 15 is moved to its open position, that is to say swung downwards as shown in FIG. 4, the air emanating from the diffuser surface 30 fluidises the ash and bed material as it falls through the aperture 14 and promotes flow of the material through the housing 16 into the influence of the air jet 21 to be conveyed pneumatically up the duct 17.

Figure 6:
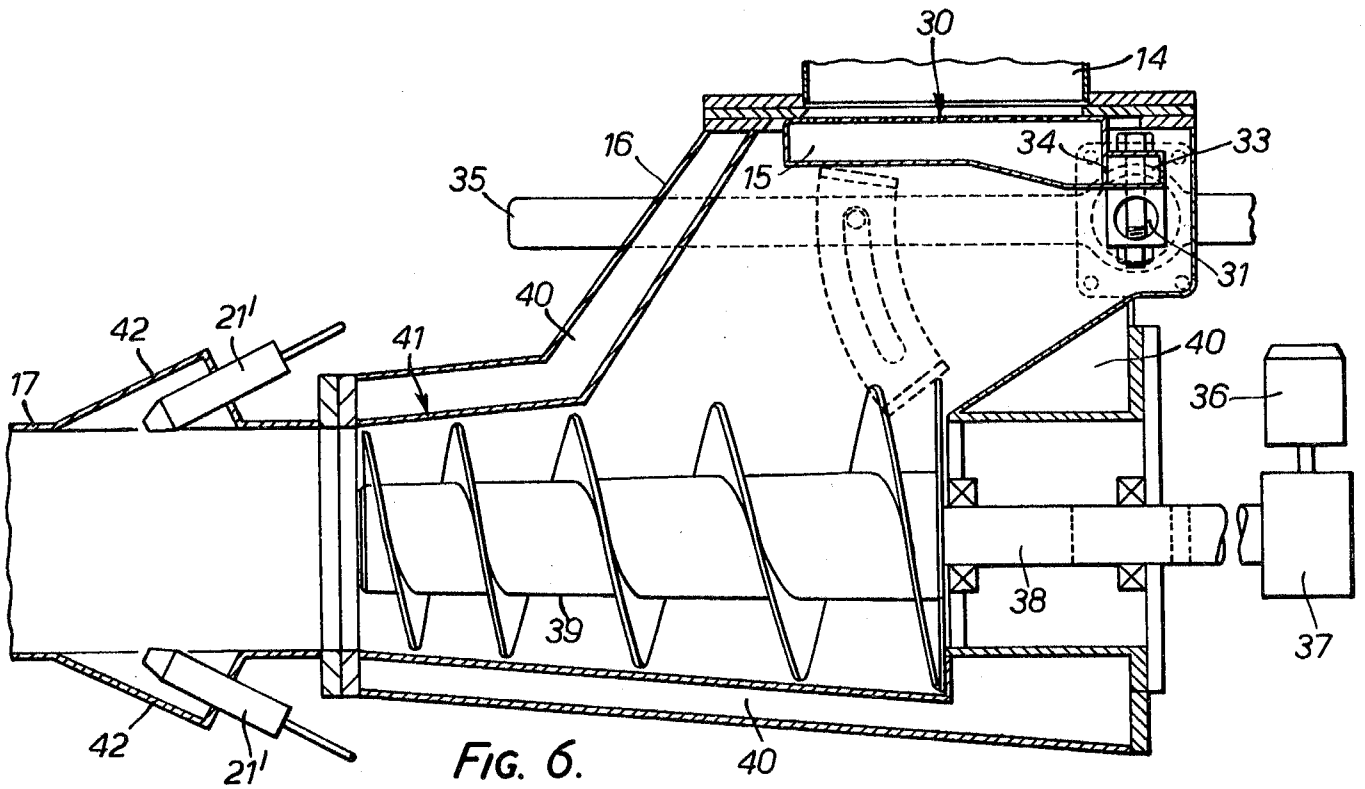
FIG. 6 shows a modification of FIG. 4.

On account of the fact that the operation of Valve 15 could choke the Ash Chamber 16 it may be necessary to control the feeding of Ash at a constant rate such that the pneumatic system works at the most efficient capacity. One method of doing this is described in FIG. 6.

The tapering screw 39 supported and shaft 38 is driven through a gearbox by a variable speed motor 36.

Air for the pneumatic feeder is supplied through air jets 21 or 21' or together, forcing the ash supplied at a constant rate by screw feeder 39 along the pneumatic feed pipe 17 and thence to the cyclone as described herein.

Thus in operation of a furnace embodying the ashing mechanism described above, when it is desired to extract incombustible ash material from the fluidised bed in operation, the flap valve 15 is opened allowing the ash which has accumulated in the trough to fall into the housing 16 and thus to be conveyed by means of the air jets 21 and (if fitted) 22, into the cyclone separator 18. It will be appreciated that among the material which is so conveyed to the cyclone separator 18, will be ash material in comparatively large lumps, the finer sand or other aggregate forming the basic fluidised bed material, and finer ash particles. The finer ash particles are separated in the cyclone separator and pass out with the air from the jets 21 and 22 through the outlet 19, whereafter the fine, or fly ash as it is called, is separated separately if necessary. The remaining heavier ash and bed material settles in the bottom of the cyclone separator to accumulate therein. Periodically the rotary valve 20 is operated to allow determined quantities of the collected material to leave the cyclone separator and it is then conveyed to a screening mechanism of known design per se for the separation of the incombustible ash material and the bed sand or aggregate which has been extracted with it.

The separated bed material can be then re-circulated back into the fluidised bed for further use therein and the ash disposed of.

By this means it can be seen that the ash can be not only conveyed away from the ash trough, but the means for conveying it is inherently cooled by the air injected into the system by the nozzles 21 and 22. This helps protect the structure of the apparatus from the effects of heat, and also rapidly cools the ash material helping to avoid any agglomeration of it through fusion or other effects.

The separated bed material can be then re-circulated back into the fluidised bed for further use therein and the ash disposed of.

By this means it can be seen that the ash can be not only conveyed away from the ash trough, but the means for conveying it is inherently cooled by the air injected into the system by the nozzles 21 and 22. This helps protect the structure of the apparatus from the effects of heat, and also rapidly cools the ash material helping to avoid any agglomeration of it through fusion or other effects.

Preferably the air from the cyclone 18, which has been used to convey the ash and bed material to the cyclone, and has thus taken heat out of the ash and bed material, is re-cycled through the blower system used to provide the air to the diffuser 12 to fluidise the bed. In this way the heat taken from the ash is retained in the combustion system and not lost with the removal of the ash. Further, the re-circulation of bed material after separation from the ash assists in minimising heat loss as the heat contained in the bed material is not lost.

The duct 17 is preferably constructed or lined with abrasion and heat resistant material to stand up to the action of the pneumatically conveyed ash and bed material in it, and the duct and the cyclone may be insulated externally against heat losses from them to further enhance thermal efficiency.

What is claimed is:

1. In a fluidised bed combustion apparatus including a housing and means for supporting and fluidising a bed of granular material in the housing for the combustion of waste or other fuel material, an ash removal means comprising:

an ash trough, arranged along an edge of the means for supporting the bed, for the collection of ash from the bed, comprising at least a bottom wall, and an aperture in the bottom wall for the exit of ash from the trough, valve means arranged in the aperture for the selective control of the flow of ash through the aperture from the trough, and pneumatic conveyor means arranged to convey ash and any bed material accompanying it from the aperture for disposal, wherein said valve means comprises a housing, mounted below the trough in communication with the aperture, and a flap valve pivotally mounted in the housing for movement between a closed position across the aperture and an open position clear of the aperture to allow flow of ash material into the housing and wherein said flap valve is formed as an air diffuser and means is provided to supply air under pressure thereto to fluidise ash and any bed material in contact with the flap valve.

2. Combustion apparatus according to claim 1, wherein said bottom wall of trough is formed as an air diffuser, and means is provided to supply air under pressure thereto, whereby ash and bed material resting in said trough may be fluidised in operation of the apparatus.

3. Combustion apparatus according to claim 1, wherein said trough includes side walls, each of which is formed as an air diffuser, and means is provided to supply air under pressure thereto, whereby ash and bed material resting in said trough may be fluidised in operation of the apparatus.

4. Combustion apparatus according to claim 1, wherein said flap valve is formed as a hollow member, and a hollow shaft is pivotally mounted in said housing to carry the flap valve and conduct the fluidising air under pressure to the interior thereof.

5. Combustion apparatus according to claim 1 including an air cyclone separator device, and wherein said pneumatic conveying means comprises a duct means connecting the air inlet of the cyclone separator with said aperture by way of said valve means, and at least one air jet arranged in the duct means to pneumatically convey ash and any bed material accompanying it along the duct to the separator.

6. Combustion apparatus according to claim 5, wherein said air jet provides the air flow for the operation of the cyclone separator.

7. Combustion apparatus according to claim 5, wherein a screening apparatus is provided connected to the outlet of the cyclone separator to separate ash from bed material in the mixture thereof separated from the air and airborne fines in the separator.

8. Combustion apparatus according to claim 5, wherein the air exit from the cyclone separator is connected to the means for fluidising the bed in the housing, whereby to return heat taken up by that air from the ash to the bed.

9. Combustion apparatus according to claim 5, wherein said duct is lined with abrasion resistant material.

10. Combustion apparatus according to claim 5, wherein said duct and said cyclone separator are externally thermally insulated.

11. Combustion apparatus according to claim 7, including means for re-circulating bed material separated from the ash in the screening means, to the bed, whereby to retain the heat in that bed material.

12. Combustion apparatus according to claim 4, wherein a counterbalance means is provided on said hollow shaft to counterbalance the weight of the flap valve.

* * * * *